US011950676B2

(12) United States Patent
Pride

(10) Patent No.: US 11,950,676 B2
(45) Date of Patent: Apr. 9, 2024

(54) TRIMMINGS COLLECTING NAIL CLIPPING DEVICE

(71) Applicant: Darnell Pride, Cookville, TN (US)

(72) Inventor: Darnell Pride, Cookville, TN (US)

( * ) Notice: Subject to any disclaimer, the term of this patent is extended or adjusted under 35 U.S.C. 154(b) by 243 days.

(21) Appl. No.: 17/577,258

(22) Filed: Jan. 17, 2022

(65) Prior Publication Data

US 2023/0225480 A1 Jul. 20, 2023

(51) Int. Cl.
*A45D 29/02* (2006.01)

(52) U.S. Cl.
CPC ..... *A45D 29/023* (2013.01)

(58) Field of Classification Search
CPC ..... A45D 29/02; A45D 29/023; A45D 2029/026; A01K 13/00
See application file for complete search history.

(56) References Cited

U.S. PATENT DOCUMENTS 2,799,923 A * 7/1957 Senshu ..... A45D 29/023 30/28
2,970,376 A * 2/1961 Chi ..... A45D 29/023 30/28
4,577,754 A 3/1986 Jones
4,614,031 A * 9/1986 Chen ..... A45D 29/023 30/28
5,195,544 A 3/1993 Campagna
5,983,498 A 11/1999 Lieberman
6,088,919 A * 7/2000 Gilman ..... A45D 29/023 30/28
6,523,545 B2 2/2003 Rende
7,222,427 B1 5/2007 Kaidi
D554,289 S 10/2007 Johnson
8,683,700 B1 * 4/2014 Kaidi ..... A45D 29/02 30/28
10,420,409 B1 * 9/2019 Crolley ..... A45D 29/02

FOREIGN PATENT DOCUMENTS

CN 107485155 A * 12/2017
CN 214127403 U * 9/2021

* cited by examiner

*Primary Examiner* — Jacqueline T Johanas
*Assistant Examiner* — Jennifer P Connell

(57) ABSTRACT

A trimmings collecting nail clipping device for hygienic nail trimming includes a lower blade extending from a first end of a bottom plate. Pairs of first and second posts extend from the bottom plate proximate to the lower blade and a second end of the bottom plate, respectively. A first terminus of a center plate is engaged to the second posts distal from the bottom plate. The center plate extends between and past the first posts. An upper blade, which is engaged to the center plate, and the lower blade define a gap. A lever is hingedly engaged to the first posts distal from the bottom plate. Upon levering of the lever, a nail positioned in the gap is severed. A panel is engageable to the bottom plate to define an interior space that receives a clipping generated upon severing of the nail.

6 Claims, 5 Drawing Sheets

TRIMMINGS COLLECTING NAIL CLIPPING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to nail clipping devices and more particularly pertains to a new nail clipping device for hygienic nail trimming. The present invention discloses a nail clipping device comprising a lever which is engaged to, and which extends between, a pair of first posts extending from a bottom plate. A clipping is able to pass freely into an interior space defined by the bottom plate, a center plate, and a panel inserted between the bottom plate and the center plate.

(2) Description of Related Art Including Information Disclosed Under 37 CFR 1.97 and 1.98

The prior art relates to nail clipping devices. Prior art nail clipping devices may comprise clippers with apertures in their bottom plates leading to containers, containers positionable around all but the levers of clippers, and clippers having substantially closed sides. The design of prior clippers is not optimal for collection of clippings as impediments to movement of the clippings are present. More specifically, most prior art nail clipping devices have a center post extending from the bottom plate, with a center plate and lever being engaged to the center post. What is lacking in the prior art is a nail clipping device comprising a lever which is engaged to, and which extends between, a pair of first posts extending from a bottom plate. A clipping is able to pass freely into an interior space defined by the bottom plate, a center plate, and a panel inserted between the bottom plate and the center plate.

BRIEF SUMMARY OF THE INVENTION

An embodiment of the disclosure meets the needs presented above by generally comprising a lower blade, which is engaged to and extends from a first end of a bottom plate. A pair of first posts and a pair of second posts are engaged to and extend from the bottom plate proximate to the lower blade and a second end of the bottom plate, respectively. A center plate is engaged by a first terminus to the second posts distal from the bottom plate. The center plate extends between and past the first posts. The center plate comprises spring steel. An upper blade is engaged to a second terminus of the center plate and extends toward the lower blade. The upper blade and the lower blade define a gap. A lever is hingedly engaged to the first posts distal from the bottom plate. The lever and the bottom plate bracket the center plate. The lever is configured to be levered so that a nail positioned in the gap is severed by the upper blade contacting the lower blade. A panel is selectively engageable to the bottom plate so that the panel, the bottom plate, and the center plate define an interior space. The interior space is configured to receive a clipping generated upon severing of the nail.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
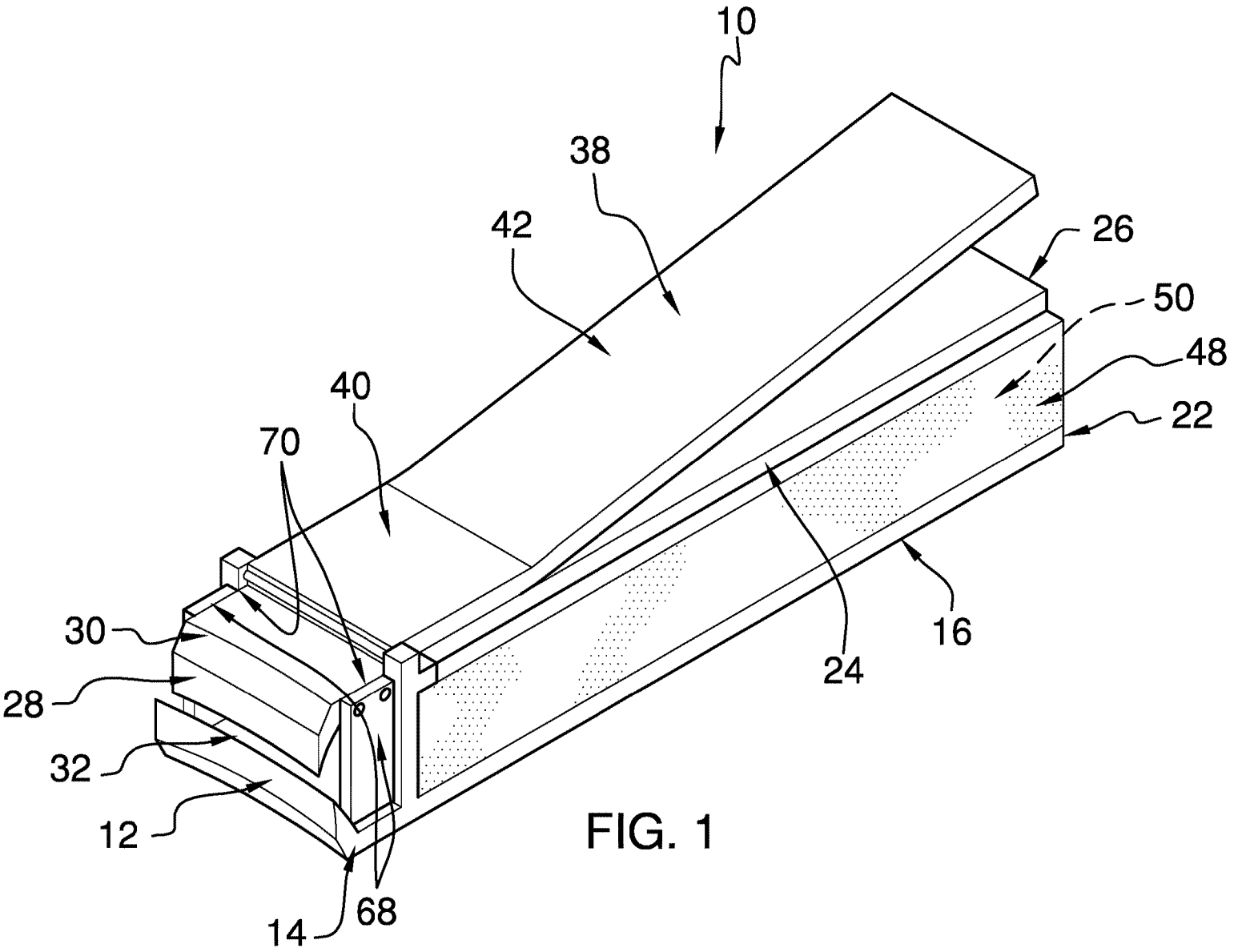
FIG. 1 is an isometric perspective view of a trimmings collecting nail clipping device according to an embodiment of the disclosure.
Figure 2:
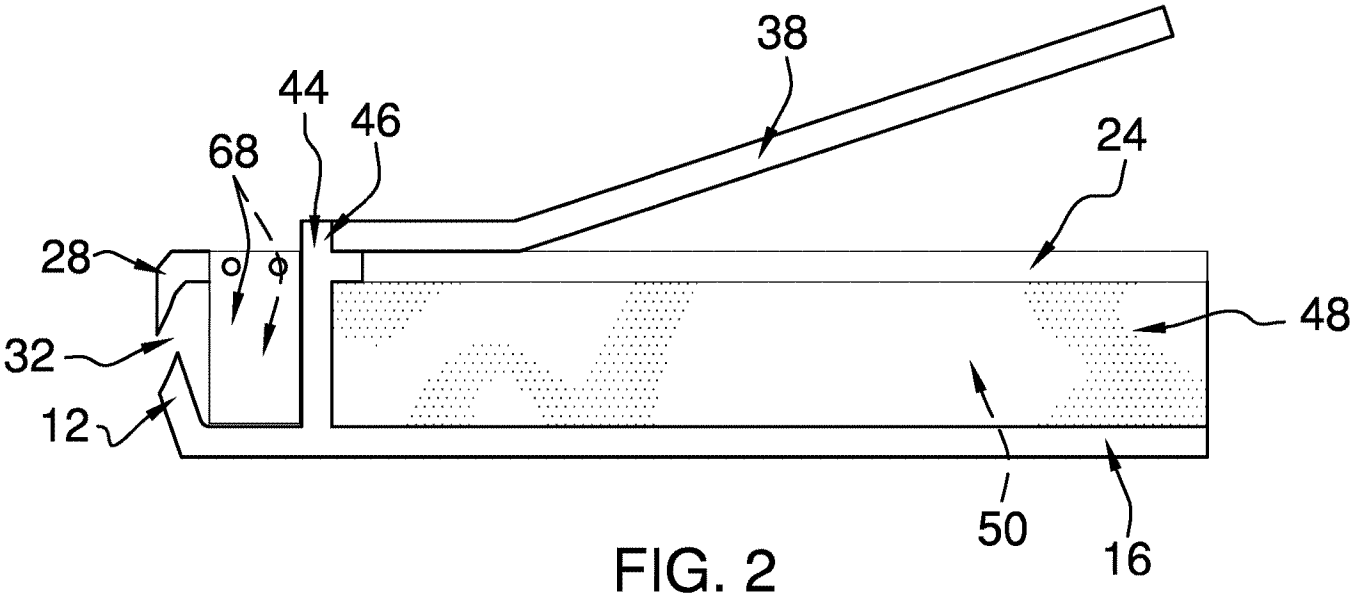
FIG. 2 is a side view of an embodiment of the disclosure.
Figure 3:
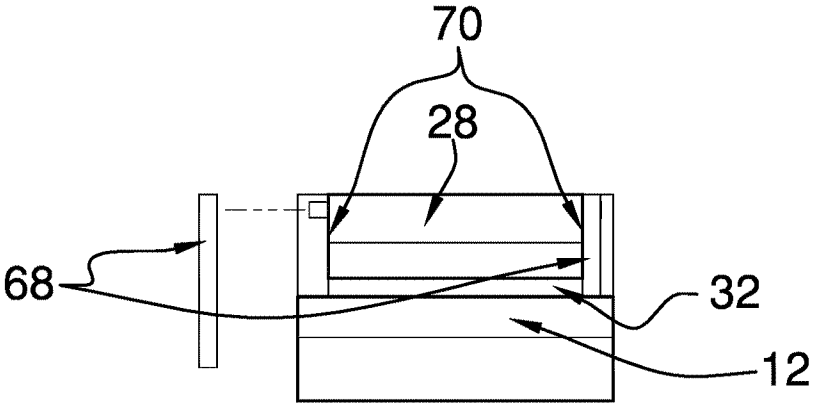
FIG. 3 is a front view of an embodiment of the disclosure.

With reference now to the drawings, and in particular to FIGS. 1 through 6 thereof, a new nail clipping device embodying the principles and concepts of an embodiment of the disclosure and generally designated by the reference numeral 10 will be described.

Figure 6:
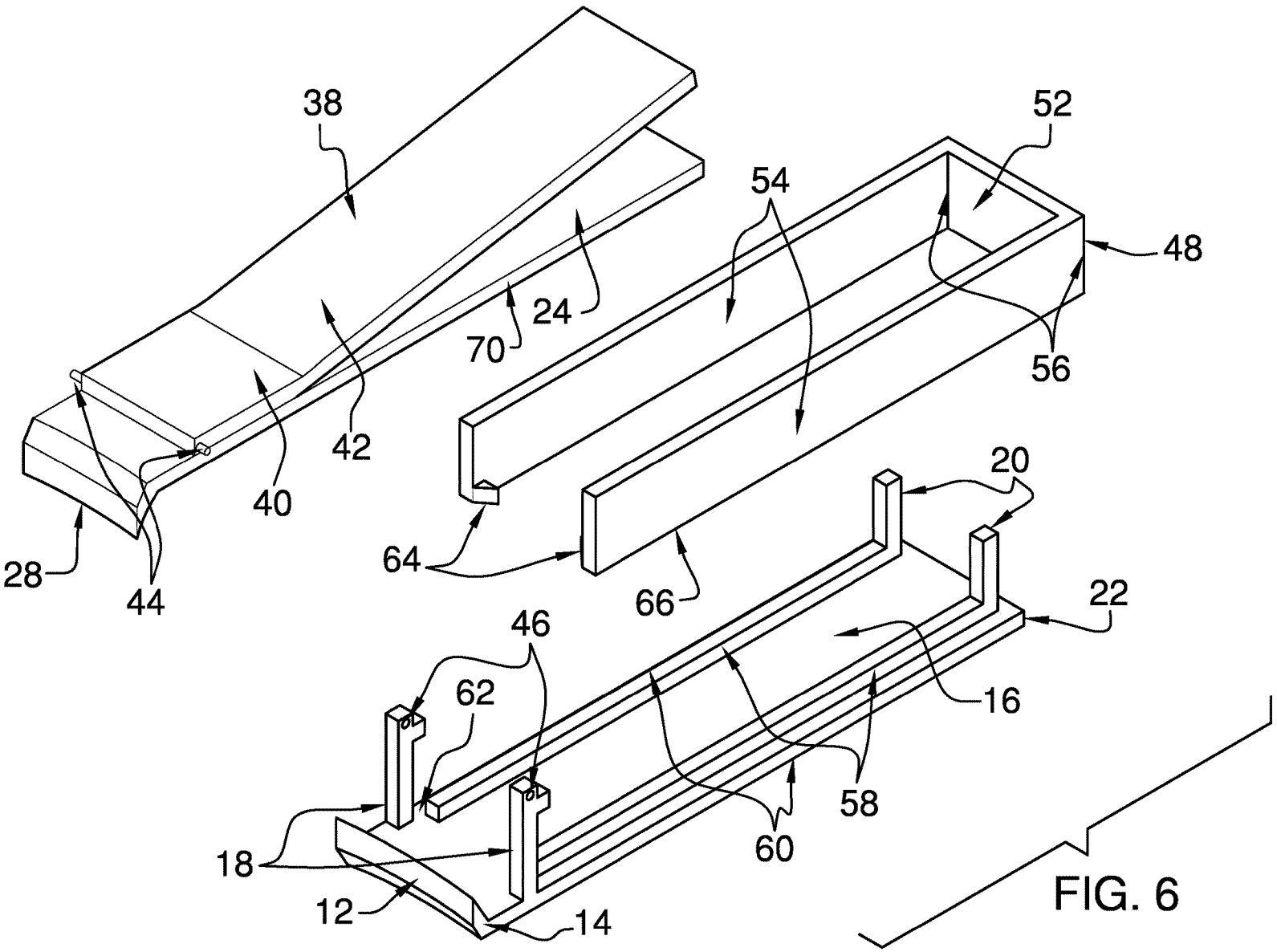
FIG. 6 is an exploded view of an embodiment of the disclosure. Center plate shown detached from second posts for clarity.

As best illustrated in FIGS. 1 through 6, the trimmings collecting nail clipping device 10 generally comprises a lower blade 12, which is engaged to and extends from a first end 14 of a bottom plate 16. A pair of first posts 18 and a pair of second posts 20 are engaged to and extend from the bottom plate 16 proximate to the lower blade 12 and a second end 22 of the bottom plate 16, respectively, as shown in FIG. 6. The present invention also anticipates the pair of second posts 20 comprising a single plate (not shown) engaged to and extending from the bottom plate.

A center plate 24 is engaged by a first terminus 26 to the second posts 20 distal from the bottom plate 16. The center plate 24 extends between and past the first posts 18. The center plate 24 comprises spring steel. An upper blade 28 is engaged to a second terminus 30 of the center plate 24 and extends toward the lower blade 12. The upper blade 28 and lower blade 12 define a gap 32. The upper blade 28 and the lower blade 12 may be convexly arcuate, as shown in FIG. 1, so that the upper blade 28 and the lower blade 12 complement a curvature of the nail.

A lever 38 is hingedly engaged to the first posts 18 distal from the bottom plate 16. The lever 38 and the bottom plate 16 bracket the center plate 24. The lever 38 is configured to be levered so that a nail positioned in the gap 32 is severed by the upper blade 28 contacting the lower blade 12, as shown in FIG. 4.

The lever 38 comprises a first section 40 and a second section 42. The first section 40 is hingedly engaged to the pair of first posts 18 and is substantially parallel to the center plate 24 when the lever 38 is in an unhinged position. The second section 42 extends transversely from the first section 40 distal from the pair of first posts 18.

A pair of hinge pins 44 is engaged to the lever 38. Each of a pair of pin holes 46 is positioned in a respective first post 18 distal from the bottom plate 16. Each hinge pin 44 is positioned in an associated pin hole 46 so that the lever 38 is hingedly engaged to the pair of first posts 18.

Figure 4:
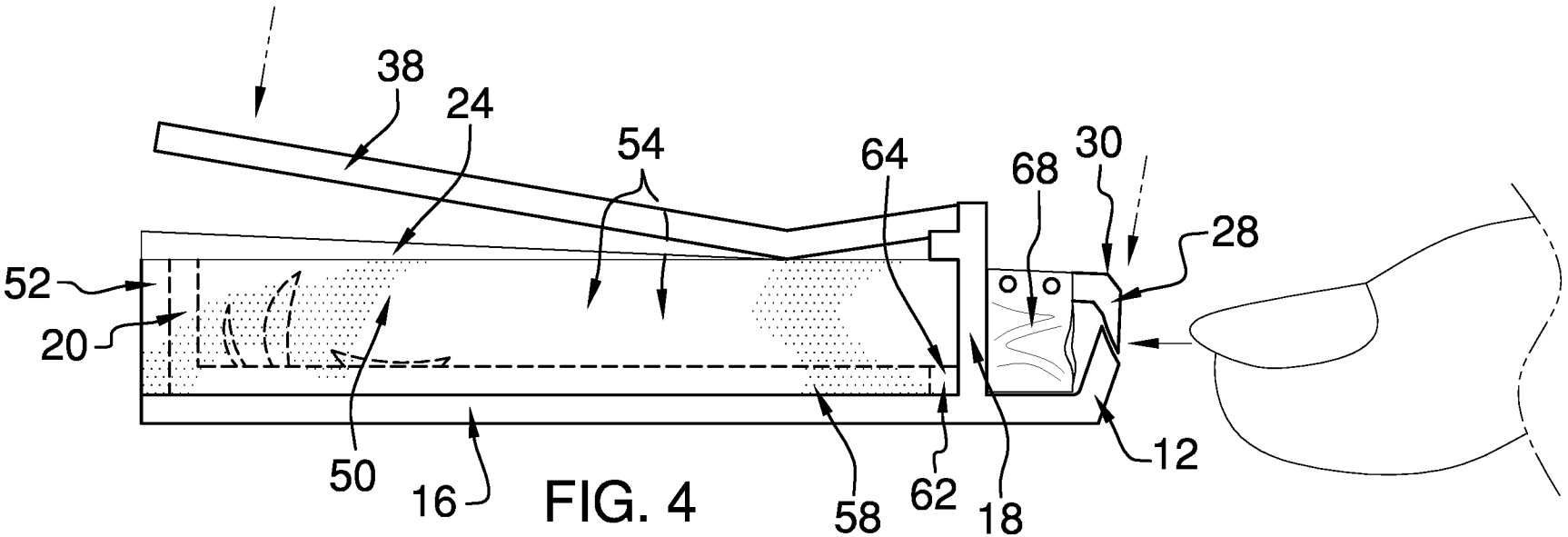
FIG. 4 is an in-use view of an embodiment of the disclosure.
Figure 5:
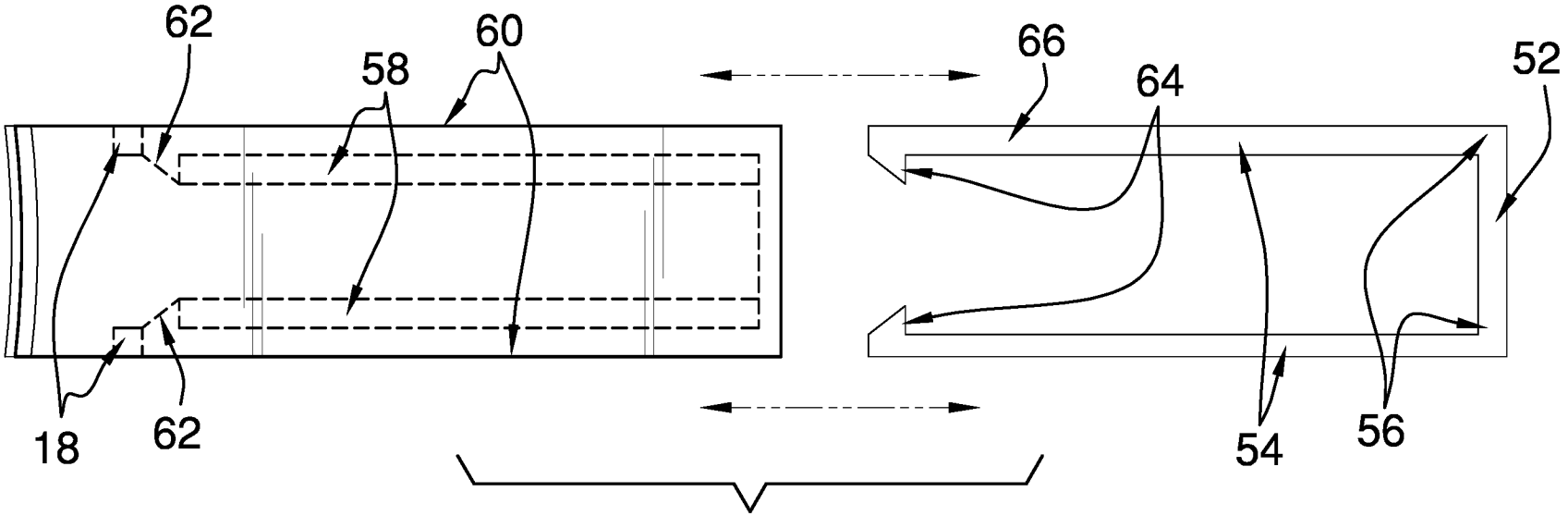
FIG. 5 is a bottom view of an embodiment of the disclosure.

A panel 48 is selectively engageable to the bottom plate 16 so that the panel 48, the bottom plate 16, and the center plate 24 define an interior space 50, as shown in FIG. 4. The interior space 50 is configured to receive a clipping generated upon severing of the nail. The panel 48 comprises an end piece 52 and a pair of side pieces 54. Each side piece 54 is engaged to and extends substantially perpendicularly from a respective opposed edge 56 of the end piece 52. The panel 48 is slidable between the bottom plate 16 and the center plate 24 until the end piece 52 abuts the pair of second posts 20.

Each of a pair of rails 58 is engaged to the bottom plate 16 proximate to a respective opposing edge 60 of the bottom plate 16. The rail 58 extends from a respective second post 20 to proximate to an associated first post 18. The rail 58 and the associated first post 18 define a tab slot 62. Each of a pair of tabs 64 is engaged to and extends transversely from a lower edge 66 of a respective side piece 54 distal from the end piece 52. The tab 64 is selectively insertable into a respective tab slot 62 to removably engage the panel 48 to the bottom plate 16.

Each of a pair of flaps 68 is engaged to a respective opposed side 70 of the center plate 24. The flap 68 is positioned between the second terminus 30 of the center plate 24 and an associated first post 18. The flaps 68 are resiliently deformable and are configured to retain the clipping between the center plate 24 and the bottom plate 16 prior to the clipping entering the interior space 50.

In use, the trimmings collecting nail clipping device 10 is grasped in digits of a hand of a user, typically with the bottom plate 16 resting on fingers of the hand and with a thumb of the hand positioned upon the lever 38. A nail then is inserted into the gap 32 and the lever 38 is levered to sever the nail. A clipping generated upon severing of the nail is prevented from becoming a projectile by the pair of flaps 68. The clipping enters the interior space 50 upon tilting of the trimmings collecting nail clipping device 10. Upon completion of nail trimming, or when convenient to the user, the panel 48 can be separated from the bottom plate 16 to empty the clippings.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A trimmings collecting nail clipping device comprising:

a bottom plate;

a lower blade engaged to and extending from a first end of the bottom plate;

a pair of first posts engaged to and extending from the bottom plate proximate to the lower blade;

a pair of second posts engaged to and extending from the bottom plate proximate to a second end of the bottom plate;

a center plate having a first terminus engaged to the second posts distal from the bottom plate, the center plate extending between and past the first posts, the center plate comprising spring steel;

an upper blade engaged to a second terminus of the center plate and extending toward the lower blade defining a gap;

a lever hingedly engaged to the first posts distal from the bottom plate, such that the lever and the bottom plate bracket the center plate, wherein the lever is configured for levering such that a nail positioned in the gap is severed by the upper blade contacting the lower blade;

a panel selectively engageable to the bottom plate, such that the panel, the bottom plate, and the center plate define an interior space, wherein the interior space is configured for receiving a clipping generated upon severing of the nail;

wherein the panel comprises an end piece, and a pair of side pieces, each side piece being engaged to and extending substantially perpendicularly from a respective opposed edge of the end piece, such that the panel is slidable between the bottom plate and the center plate until the end piece abuts the pair of second posts:

a pair of rails, each rail being engaged to the bottom plate proximate to a respective opposing edge of the bottom plate, the rail extending from a respective second post to proximate to an associated first post, such that the rail and the associated first post define a tab slot; and a pair of tabs, each tab being engaged to and extending transversely from a lower edge of a respective side piece distal from the end piece, such that the tab is selectively insertable into a respective tab slot for removably engaging the panel to the bottom plate.

2. The trimmings collecting nail clipping device of claim 1, wherein the upper blade and the lower blade are convexly arcuate, such that the upper blade and the lower blade complement a curvature of the nail.

3. The trimmings collecting nail clipping device of claim 1, wherein the lever comprises:

a first section hingedly engaged to the pair of first posts, the first section being substantially parallel to the center plate when the lever is in an unhinged position; and a second section extending transversely from the first section distal from the pair of first posts.

4. The trimmings collecting nail clipping device of claim 1, further including:

a pair of hinge pins engaged to the lever; and a pair of pin holes, each pin hole being positioned in a respective first post distal from the bottom plate, each hinge pin being positioned in an associated pin hole, such that the lever is hingedly engaged to the pair of first posts.

5. The trimmings collecting nail clipping device of claim 1, further including a pair of flaps, each flap being engaged to a respective opposed side of the center plate, the flap being positioned between the second terminus of the center plate and an associated first post, the flaps being resiliently deformable, wherein the pair of flaps is configured for retaining the clipping between the center plate and the bottom plate prior to the clipping entering the interior space.

6. A trimmings collecting nail clipping device comprising:

a bottom plate;

a lower blade engaged to and extending from a first end of the bottom plate;

a pair of first posts engaged to and extending from the bottom plate proximate to the lower blade;

a pair of second posts engaged to and extending from the bottom plate proximate to a second end of the bottom plate;

a center plate having a first terminus engaged to the second posts distal from the bottom plate, the center plate extending between and past the first posts, the center plate comprising spring steel;

an upper blade engaged to a second terminus of the center plate and extending toward the lower blade defining a gap, the upper blade and the lower blade being convexly arcuate, such that the upper blade and the lower blade complement a curvature of a nail;

a lever hingedly engaged to the first posts distal from the bottom plate, such that the lever and the bottom plate bracket the center plate, wherein the lever is configured for levering such that a nail positioned in the gap is severed by the upper blade contacting the lower blade, the lever comprising:

a first section hingedly engaged to the pair of first posts, the first section being substantially parallel to the center plate when the lever is in an unhinged position, and a second section extending transversely from the first section distal from the pair of first posts;

a pair of hinge pins engaged to the lever;

a pair of pin holes, each pin hole being positioned in a respective first post distal from the bottom plate, each hinge pin being positioned in an associated pin hole, such that the lever is hingedly engaged to the pair of first posts;

a panel selectively engageable to the bottom plate, such that the panel, the bottom plate, and the center plate define an interior space, wherein the interior space is configured for receiving a clipping generated upon severing of the nail, the panel comprising:

an end piece, and a pair of side pieces, each side piece being engaged to and extending substantially perpendicularly from a respective opposed edge of the end piece, such that the panel is slidable between the bottom plate and the center plate until the end piece abuts the pair of second posts;

a pair of rails, each rail being engaged to the bottom plate proximate to a respective opposing edge of the bottom plate, the rail extending from a respective second post to proximate to an associated first post, such that the rail and the associated first post define a tab slot;

a pair of tabs, each tab being engaged to and extending transversely from a lower edge of a respective side piece distal from the end piece, such that the tab is selectively insertable into a respective tab slot for removably engaging the panel to the bottom plate; and a pair of flaps, each flap being engaged to a respective opposed side of the center plate, the flap being positioned between the second terminus of the center plate and an associated first post, the flaps being resiliently deformable, wherein the pair of flaps is configured for retaining the clipping between the center plate and the bottom plate prior to the clipping entering the interior space.

* * * * *